United States Patent [19]

Wagner

[11] Patent Number: 4,494,524

[45] Date of Patent: Jan. 22, 1985

[54] CENTRIFUGAL HEATING UNIT

[76] Inventor: Lee Wagner, Box 128, Buffalo Gap, S. Dak. 57722

[21] Appl. No.: 399,440

[22] Filed: Jul. 19, 1982

[51] Int. Cl.[3] ..... F24C 9/00

[52] U.S. Cl. ..... 126/247; 122/26

[58] Field of Search ..... 126/247; 122/26; 165/86; 237/12.1; 366/144, 149, 245, 249, 341; 415/90; 416/179

[56] References Cited

U.S. PATENT DOCUMENTS

| | | | |
|---|---|---|---|
| 1,682,102 | 8/1928 | Allen | 126/247 |
| 2,090,873 | 8/1937 | Lazarus | 126/247 |
| 2,520,729 | 8/1950 | Kollsman | 257/244 |
| 3,164,147 | 1/1965 | Love et al. | 126/247 |
| 3,333,771 | 8/1967 | Graham | 126/247 X |
| 3,791,167 | 2/1974 | Eskeli | 63/401 |
| 4,004,553 | 1/1977 | Stenstrom | 122/26 |
| 4,060,194 | 11/1977 | Lutz | 237/1 SL |
| 4,143,639 | 3/1979 | Frenette | 126/247 |
| 4,256,085 | 3/1981 | Line | 126/247 |
| 4,273,075 | 6/1981 | Freihage | 122/26 |
| 4,277,020 | 7/1981 | Grenier | 237/1 R |
| 4,285,329 | 8/1981 | Moline | 126/247 |
| 4,365,614 | 12/1982 | Grover | 126/247 |

*Primary Examiner*—Randall L. Green

*Attorney, Agent, or Firm*—Kinney & Lange

[57] ABSTRACT

A centrifugal heating unit includes a circular plate unit mounted on a rotatable shaft in a housing. A motor rotates the shaft and spins the plate unit within the housing. The plate unit is immersed in multi-viscosity synthetic oil. The plate unit includes first and second circular disks of equal diameter which are attached to and separated by a spacer disk of smaller diameter. A peripheral buffeting area is formed between the disks outside the perimeter of the separator plate. Each disk of the plate unit is provided with slots equally spaced around the periphery, extending from the separator plate out to near the perimeter of the disk. Each slot is aligned at a 45° angle to a radius of its disk. As the plate unit rotates, oil moving radially outward due to centrifugal force is drawn through the slots into the buffeting area between the disks where it is buffeted, which generates heat. The hot oil heats the housing, from which heat is transferred to warm the ambient air.

29 Claims, 4 Drawing Figures

CENTRIFUGAL HEATING UNIT

BACKGROUND OF THE INVENTION

1. Field of the Invention

The present invention relates to heating systems.

2. Description of the Prior Art

Many attempts have been made to create heat in fluids by producing internal friction through turbulence. The following United States patents were found in a prior art search conducted before the filing of the present application:

| Inventor | U.S. Pat. No. | Issue Date |
|---|---|---|
| Moline | 4,285,329 | 08/25/81 |
| Grenier | 4,277,020 | 07/07/81 |
| Freinage | 4,273,075 | 06/16/81 |
| Line | 4,256,085 | 03/17/81 |
| Lutz | 4,060,194 | 11/29/77 |
| Stenstrom | 4,004,553 | 01/25/77 |
| Eskeli | 3,791,167 | 02/12/74 |
| Love et al | 3,164,147 | 01/05/65 |
| Kollsman | 2,520,729 | 08/29/50 |

U.S. Pat. No. 2,520,729 to Kollsman discloses a finned rotor with passages for expanding input gas as it moves towards the axis of rotation and for recompressing the gas and moves out through other passages. The gas is heated during the expansion phase. The heat is drawn from the gas in the recompression phase to preheat gas in the expansion phase.

U.S. Pat. No. 3,164,147 to Love et al discloses rotating disks which rub to generate heat from friction. The frictional heat is transferred to an oil bath surrounding the rubbing disks.

U.S. Pat. No. 3,791,167 to Eskeli discloses a heat exchange apparatus in which heat is passed between two fluids, at least one of which is compressible. The fluids pass in opposite direction through parallel passages which go around the periphery of a rotor.

U.S. Pat. No. 4,060,194 to Lutz discloses an apparatus for pumping a silicone fluid through an element with a plurality of small openings. The fluid is heated by the compressional shear forces as it is forced through the small openings.

U.S. Pat. No. 4,256,085 to Line discloses an impeller rotatably mounted within a heat transfer liquid. Heat is generated by the frictional forces created by the rotating impeller. The patent discloses that a rough cast surface supplies more frictional heat than a smooth polished surface. It suggests that it may be necessary to score the surface of plastic materials used for the impeller.

U.S. Pat. No. 4,277,020 to Grenier discloses a method of heating fluid by frictional agitation in passages formed between the interior surface of a housing and the exterior of a rotatable drum.

U.S. Pat. No. 4,273,075 to Freihage discloses a sealed metal drum with a rotatable agitator for forcing oil to the inner wall of the drum. The oil is heated by the shearing force of movement between vanes on the agitator.

U.S. Pat. No. 4,004,553 to Stenstrom discloses a rotatable disk which heats fluid that is passed around the periphery of the disk. The device is used for heat treating liquids, such as in the pasteurization of milk. The turbulence in the peripheral areas of the rotating disk heats the liquid. The patent discloses the intensifying effect of a rough, grooved, or uneven surface on the rotating disk.

U.S. Pat. No. 4,285,329 to Moline discloses a friction heat generator having stationary and rotatable friction disk assemblies. A thin fluid film lies between each pair of disks. The heat is created by the shearing of the thin fluid film. The application discloses radial channels for centrifugally forcing the liquid to the peripheral edge.

The teaching of the prior art has been to attempt to produce heat by rotating a member in relation to a stationary wall. The heat recovered is relatively small compared to the electricity or other energy expended to rotate the member.

The various grooves and rough surfaces shown in the prior art disks merely attempt to induce additional turbulence between the moving member and the stationary wall.

SUMMARY OF THE INVENTION

A centrifugal heating system includes a housing which is preferably made of heat conductive material such as aluminum. A housing defines a chamber for containing a viscous liquid, such as multi-viscosity synthetic oil.

A plate unit is positioned within the housing for rotation about a drive axis while immersed in the viscous liquid. The plate unit includes first and second disks of generally equal diameter, having first and second passage means, respectively, for permitting flow of viscous liquid through the disks. An attachment means is provided for attaching the disks in a coaxially spaced apart, fixed relation and for forming a region between the disks near the periphery of the plate unit in communication with the first and second passage means. The attachment means is preferably a spacer disk of smaller diameter than the first and second disks which is sandwiched between the first and second disks.

Motor means is provided for rotating the plate unit about the drive axis within the chamber to cause heating of the viscous liquid. This is preferably a motor rotating a vertical shaft to which the plate unit is attached.

The passage means preferably includes a plurality of first slots in the first disk and second slots in the second disk. Each slot is preferably aligned at a 45° angle to a radius of its disk. The slots are preferably equally spaced around the periphery of each disk and the first slots of the first disk are preferably offset from the second slots of the second disk.

As liquid is centrifugally forced outward by rotation of the plate unit, liquid is passed through the first and second passage means into the region between the disks. The turbulence generates frictional heat within the liquid. This generated heat is transferred to the housing.

A plenum is preferably provided for exchanging heat from the housing to air. Heat exchanging fins on the housing preferably aid in exchanging heat to surrounding air.

DETAILED DESCRIPTION OF THE PREFERRED EMBODIMENTS

Figure 1:
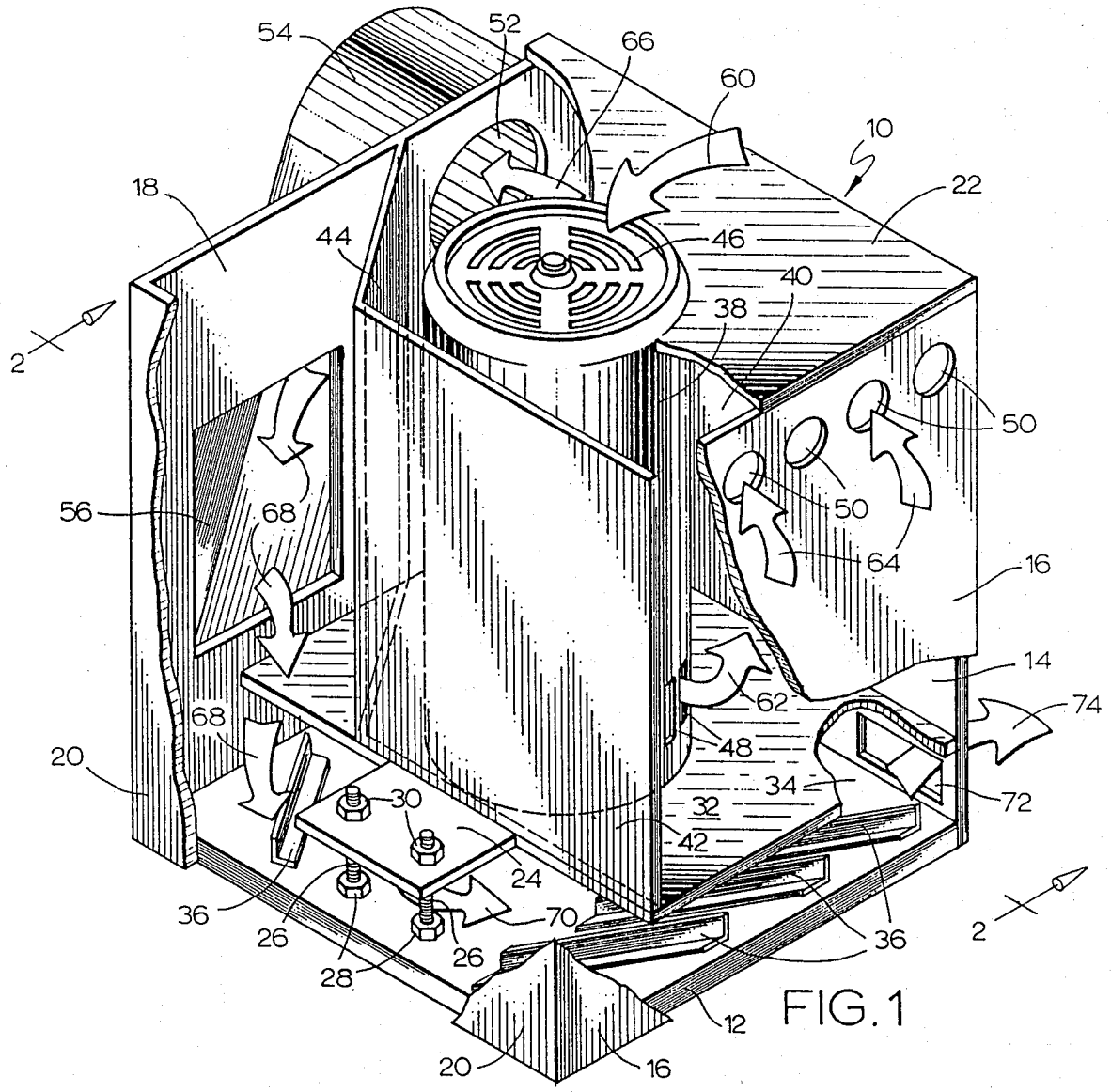
FIG. 1 is a perspective cutaway view of a heating system constructed according to the present invention.

A heater 10, as illustrated in FIG. 1, includes a centrifugal heating housing 12, constructed according to the present invention. Housing 12 is shaped like a generally square, low box. Housing 12 is preferably made of heat conductive material such as aluminum. Heater 10 is enclosed by side walls 14, 16, 18, and 20, which are positioned generally vertically and attached in a box-like fashion with their bases mounted on housing 12. A top wall 22 is mounted on the tops of side walls 14, 16, 18 and 20 to enclose heater 10.

A motor mount standard 24 is supported on housing 12 by bolts 26. In the example illustrated, nuts 28 are brazed or welded to housing 12. Bolts 26 are then threadably mounted in nuts 28. Motor mount standard 24 is then adjustably mounted on bolts 26 and fastened with conventional fasteners, such as nuts 30.

A generally horizontal plenum wall 32 is attached to motor mount standard 24 and is attached to walls 14, 16, and 18. Plenum wall 32 does not extend to wall 20. There is air passage space between plenum wall 32 and wall 20. The area above housing 12 and below plenum wall 32 is a plenum 34 in which heat is exchanged from housing 12 to air. Heat exchanging fins 36 are mounted on housing 12 to facilitate the transfer of heat from housing 12 to air. In the example illustrated, heat exchanging fins 36 are aluminum angle bars brazed to the aluminum housing 12.

Motor means includes an electric motor 38 mounted on motor mount standard 24 is a generally vertical direction. A motor compartment 40 surrounding motor 38 is partially formed by plenum wall 32, wall 14, wall 16, wall 18, and top wall 22. The remaining side is partially formed by a partition wall 42 which extends between plenum wall 32 and top wall 22, from wall 16 partially across interior of heater 10. A diagonal wall 44, which extends from partition wall 42 to wall 18, completes the enclosure of motor compartment 40.

An air intake vent 46 on the top end of motor 38 extends upward through top wall 22. A hot air outlet vent 48 on motor 38 exhausts heated motor air into motor compartment 40. In a preferred embodiment, cooling fins normally present within motor 38 are removed to increase air flow through motor 38 and into motor compartment 40. Drawing room temperature air through motor 38 prolongs motor life, and makes use of heat generated by motor 38.

Additional outside air is taken into motor compartment 40 through air inlets 50 in side wall 16. The air inlets 50 pictured are circular holes, however any appropriate inlet vent configuration may be used. Air filters (not shown) are preferably included to reduce intake of dust and dirt into motor 38 and motor compartment 40.

Motor compartment 40 has an outlet duct 52 which leads to means for moving air, which, in this example, is a squirrel-cage fan 54. An outlet duct 56 of fan 54 is open to plenum 34 through the area between diagonal wall 44, partition wall 42, wall 16, wall 18, and wall 20.

Movement of air through heater 10 is illustrated by arrows in FIG. 1. Cooling air is drawn in through air intake vent 46 into motor 38 in the direction of arrow 60. After cooling the motor 38, the air is exhausted through outlet vent 48 in the direction of arrow 62.

Outside air is taken in through air inlets 50 as illustrated by arrows 64. Air from air inlets 50 is drawn through motor compartment 40 so that any heat generated by motor 38 is circulated through heater 10 and is not wasted. Fan 54 draws the air from motor compartment 40 through outlet duct 52, as shown by arrow 66. Air is driven by fan 54 through duct 56 down into plenum 34 as illustrated by arrows 68.

Air travels through plenum 34, as shown by arrow 70, across housing 12. The air draws heat from the top surface of housing 12 and from heat exchanging fins 36, as it passes through plenum 34.

The heated air in plenum 34 is driven out through an outlet duct 72 in wall 14, in the direction of arrow 74.

Figure 2:
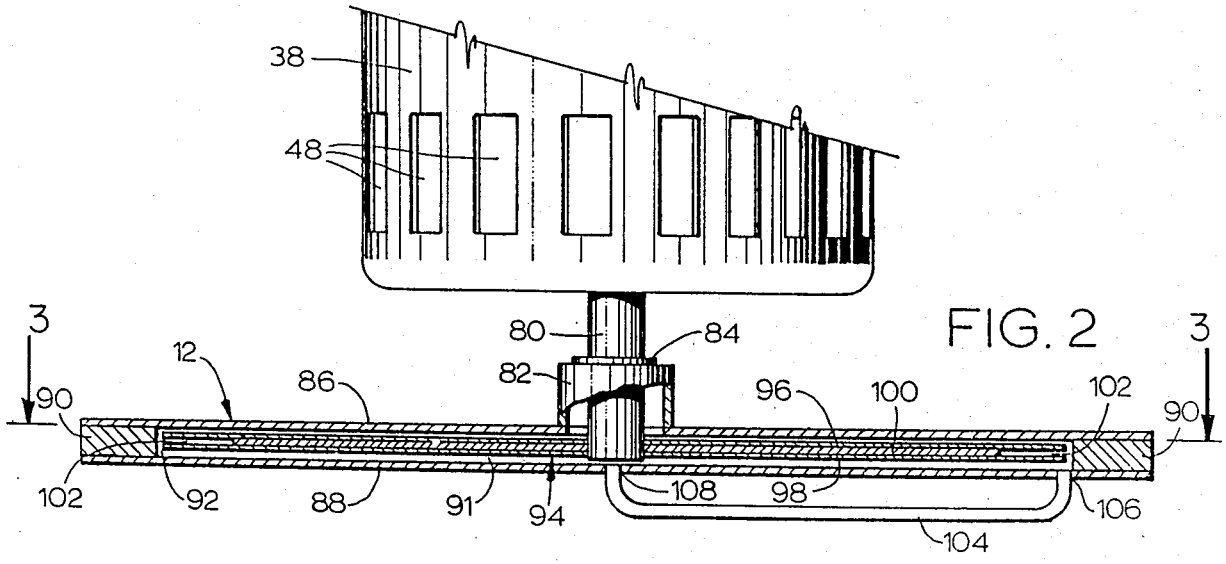
FIG. 2 is a fragmentary, partially cross sectional view taken on line 2—2 of FIG. 1.

Housing 12 and motor 38 of the heater 10 of FIG. 1 are shown in partial cross section in FIG. 2. For clarity, motor mount standard 24, heat exchanger fins 36 and other portions of heater 10 are not illustrated in FIG. 2. The motor 38 drives a generally vertical shaft 80 which is rotatably mounted in housing 12 to form a drive axis. Shaft 80 extends through an oil expansion chamber 82 which is mounted on housing 12. A seal 84 mounted on the top of expansion chamber 82 around shaft 80 prevents odors produced by oil from escaping from housing 12. Centrifugal action eliminates any pressure on seal 84, and in fact creates a slight vacuum or suction at the top center of housing 12 near oil expansion chamber 82 and seal 84.

Housing 12 includes generally parallel top wall 86 and a bottom wall 88. Walls 86 and 88 are preferably constructed of material which has a high heat conductivity. In the example illustrated, walls 86 and 88 are made of fourteen inch by fourteen inch by 0.100 inch thick tempered aluminum. Walls 86 and 88 are attached at their edges by four spacer blocks or side walls 90 to form an enclosed chamber 91. In this example, spacer blocks 90 are constructed of three-eighths inch by one inch aluminum bar stock. Chamber 91, in this embodiment, is twelve inches square and has a thickness of 0.375 inch.

The interior chamber 91 of housing 12 formed by plates 86 and 88 and spacer blocks 90 contains liquid 92. Liquid 92 is preferably multi-viscosity synthetic oil, such as S.A.E. 5W30 or 5W40. In the preferred embodiment shown, about one pint of liquid 92 is contained in chamber 91.

Plate unit 94 is fixedly mounted to shaft 80 within chamber 91 of housing 12, so that it is surrounded by and immersed in liquid 92. Plate unit 94 includes a first or top disk 96 and a second or bottom disk 98. Means for attaching disk 96 to disk 98 in a spaced apart coaxial relation includes, in this example, a separator or spacer disk 100.

In the example illustrated, disks 96 and 98 are eleven and seven-eighths inch diameter circular aluminum disks which are smoothly polished. Spacer plate 100, which is sandwiched between disks 96 and 98, is a ten inch diameter tungsten disk. In the preferred embodiment, disks 96 and 98 are 0.100 inch thick aluminum. Spacer disk 100 is preferably 0.077 inches thick. Disks 96 and 98 and spacer disk 100 are fixedly attached, such as by riveting, to form the plate unit 94, which rotates as a unit when motor 38 rotates shaft 80.

An internal region or buffeting area 102 is formed around the periphery of plate unit 94 between top disk 96 and bottom disk 98, outside the perimeter of spacer disk 100. Buffeting area 102 is a generally circular internal path around the periphery of the plate unit 94, which is for the passage and buffeting of liquid 92 during operation of the heating system constructed according to the present invention.

A liquid return tube 104, which preferably provides a 5/16 inch passage, is mounted on an underside of bottom wall 88 of housing 12. Return tube 104 is open at a first end 106 to an internal peripheral area of housing 12. A second end 108 of return tube 104 is open to a generally central internal area of housing 12. Liquid 92 is free to move through return tube 104, from end 106 to end 108, during rotation of plate unit 94. This allows liquid 92 to circulate from the outer edge of plate unit 94 (where it is heated, as described later) back to the center of plate unit 94, thus allowing more even heat distribution within chamber 91.

Figure 3:
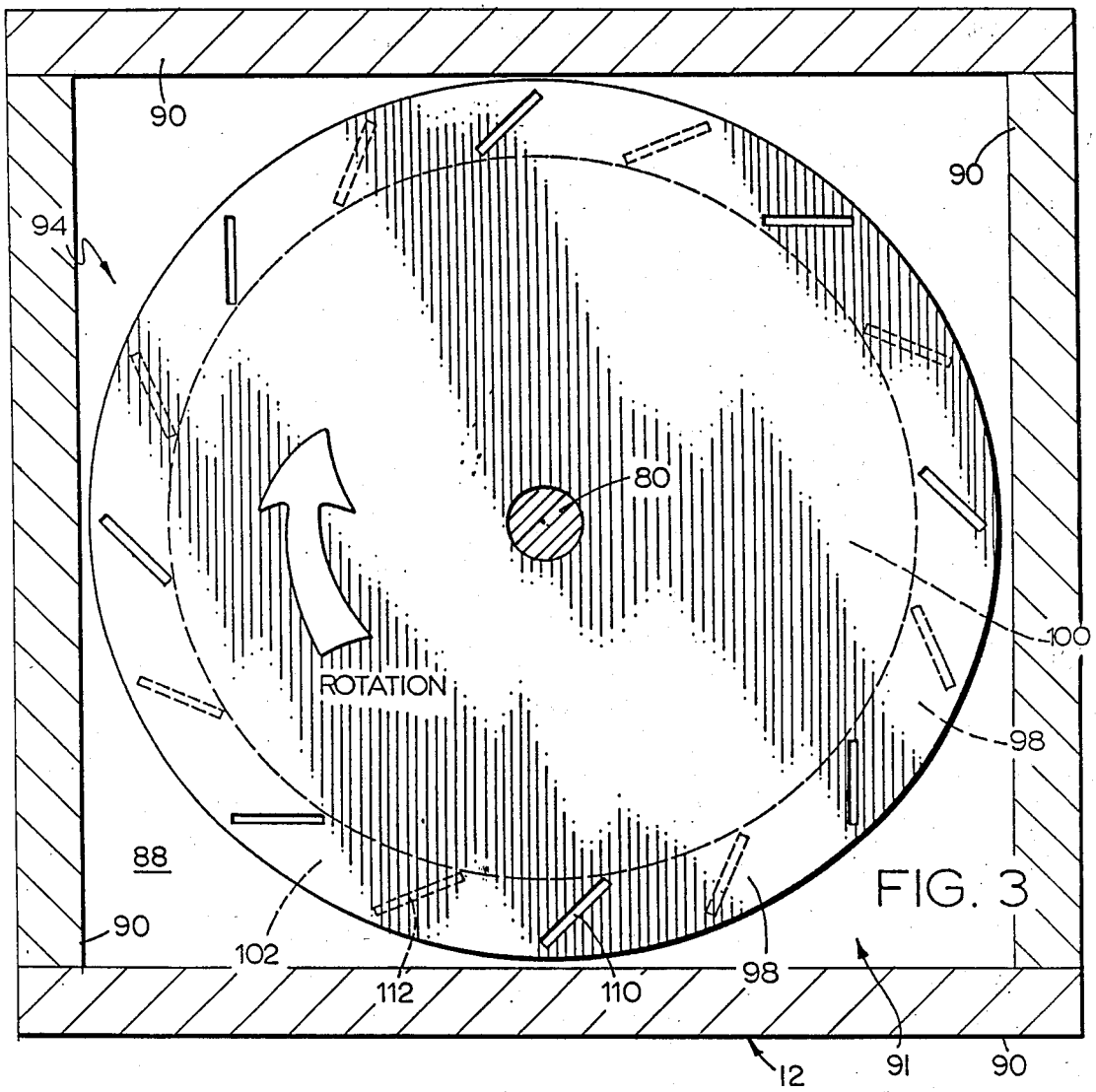
FIG. 3 is a sectional view taken on line 3—3 of FIG. 2.

Plate unit 94 includes a passage means for passing oil from the top or bottom of plate unit 94 into internal buffeting area 102. In the preferred embodiment, the passage means comprises first slots 110 in top disk 96 and second slots 112 in bottom disk 98, as illustrated in FIG. 3. Each first slot 110 is preferably aligned at an angle to a radius of top disk 96. Each second slot 112 is preferably aligned at the same angle to a radius of bottom disk 98. The preferred angle is 45°. Slots 110 and 112 are preferably equally circumferentially spaced around the periphery of disks 96 and 98, respectively. As illustrated in FIG. 3, the preferred alignment of slots 110 and 112 is such that they are offset. That is, disk 96 and 98 are aligned so that each second slot 112 is medially spaced between a pair of first slots 110. In the preferred embodiment shown, there are eight equally circumferentially spaced first slots 110 and eight equally circumferentially spaced second slots 112.

Slots 110 and 112 preferably extend from the perimeter of spacer disk 100 out to near the perimeter of disks 96 and 98, respectively. In the illustrated example, slots 110 and 112 extend to one-eighth inch from the perimeter of disks 96 and 98. Slots 110 and 112 are approximately 3/16 inches wide and overlap generally the entire width of internal buffeting area 102. Slots 110 and 112 are open to buffeting area 102 within plate unit 94.

Figure 4:
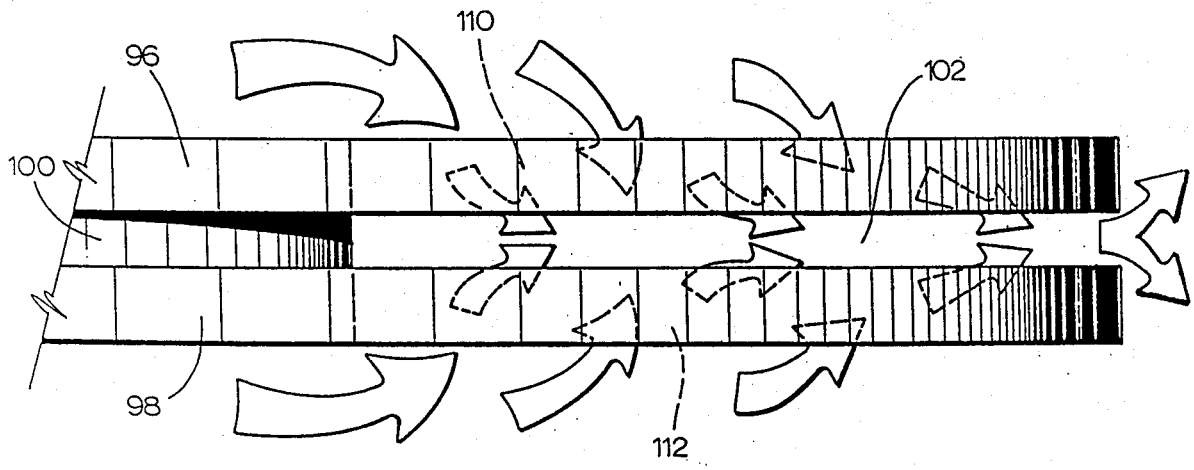
FIG. 4 is an enlarged partial side view of the periphery of the plate unit of FIG. 3.

While the scientific principles underlying the substantial heat generation provided by the present invention are not fully understood, it is believed that heat is generated in the following manner. When motor 38 rotates plate unit 94, liquid 92 is thrown outward centrifugally towards the perimeter of housing 12. In the preferred embodiment described, motor 38 is a one horsepower electric motor which rotates plate unit 94 at about 1140 rpm. This creates about four pounds pressure on liquid 92 near the outer edges of plate unit 94. This outward flow of liquid 92 along disks 96 and 98 is opposed by inwardly angled slots 110 and 112. Liquid 92 hitting slots 110 and 112 is drawn inward as shown by the arrows in FIG. 4. The liquid 92 drawn though the slots 110 and 112 is buffeted against other liquid 92 in internal buffeting area 102, which is extremely turbulent. The turbulence generates heat in liquid 92 due to internal molecular friction. As liquid 92 is thrown centrifugally out of area 102 to the perimeter of housing 12, housing 12 is heated. This heat, in turn, is exchanged to air in a manner such as illustrated in FIG. 1. Oil from the high pressure area along the periphery of housing 12 then passes through oil return tube 104 to a lower pressure area in the center of housing 12.

It has been found by practical experimentation that the buffeting of liquid 92 in area 102 generates relatively high heat, which results in very efficient conversion of electrical energy to heat. Experimentation has also shown the heat generation in internal buffeting area 102 of a system constructed according to the present invention greatly exceeds that of typical devices in which a member is rotated in the housing. A single blade rotating in a housing, such as housing 12, results in very little beneficial heat. The use of plate unit 94, constructed according to the present invention as illustrated, rotating at 1140 rpm generates approximately 30,000 BTU. It appears that the substantial heat generated by the present invention occurs in the buffeting area 102 between disks 96 and 98 and between disks 96 and 98 and the inner walls of housing 12.

In the example illustrated, the spacing between top disk 96 and top wall 86 is 0.025 inches. Spacing between bottom disk 98 and bottom wall 88 is 0.073 inches. The difference between these spacings results in a mild vacuum at the center of housing 12 near the top where shaft 80 enters. It also results in about four pounds of pressure at the bottom of housing 12 and at the peripheral edge. This spacing results in approximately 30% more heat than if the top and bottom spacings were equal.

In other preferred embodiments of the present invention, multiple housings 12 (each with an internal plate unit 94) are stacked and their plate units are driven on a common shaft 80 to increase the BTU output of the heating system. The additional housing units increase the heat output in proportion to the number of units. For example, a 90,000 BTU heater is constructed in a manner identical to the embodiment illustrated except it employs three stacked housings 12 and a larger (3 HP, 240 V) electric motor 38.

The present invention has a number of important advantages. First, the present invention converts electrical energy (which drives motor 38) to heat very efficiently.

Second, the present invention is simple in construction, with a minimum of moving parts. There are no parts to wear or malfunction. This makes it trouble and maintenance free, and allows it to run unattended for long periods of time. In addition, the simple construction makes it relatively low in manufacturing cost.

Third, the present invention is relatively small in size.

Fourth, the modular construction of the present invention allows heat output to be multiplied easily by connecting several units together in a stack and driving them with a common motor.

Fifth, the direct fixed connection of plate unit 94 to motor shaft 80, eliminates the need for complex bearings and seals, and utilizes the direct, full power of motor 38.

Sixth, the present invention is compatible with conduction, convection, and radiant heating systems. It is easily controlled using conventional thermostats and heat switches.

Seventh, the present invention provides heating without a flame, smoke, or venting, as in conventional furnaces.

Although the present invention has been described with reference to preferred embodiments, workers skilled in the art will recognize that changes may be made in form and detail without departing from the spirit and scope of the invention.

What is claimed is:

1. A heating apparatus comprising:

a housing defining a chamber for containing a viscous liquid, the chamber being defined by a plurality of generally planar walls which meet at opposed corners spaced about a periphery of the chamber in cross-section along a first plane;

a plate unit positioned within the chamber for rotation about a central drive axis while immersed in the viscous liquid, the drive axis being perpendicular to the first plane and the plate unit comprising:

a first disk generally perpendicular to the drive axis, the first disk having its periphery in close tolerance to an intermediate portion of each of the walls and having a first passage means for permitting flow of viscous liquid through the first disk;

a second disk generally perpendicular to the drive axis, the second disk having its periphery in close tolerance to an intermediate portion of each of the walls and having second passage means for permitting flow of viscous liquid through the second disk;

means for attaching the first and second disks in an axially spaced apart, generally parallel, fixed relation with a region between the first and second disks in communication with the first and second passage means; and motor means for rotating the plate unit about the drive axis within the chamber to cause heating of the viscous liquid.

2. The heating apparatus of claim 1 wherein the first and second passage means are positioned around peripheral areas of the first and second disks, respectively, to cause passage of the viscous liquid through the respective first and second disks and into the region between the first and second disks as the viscous liquid is centrifugally forced outward by rotation of the plate unit, thus causing generation of heat due to turbulence of the viscous liquid in the region between the disks.

3. The heating apparatus of claim 1 wherein the first passage means includes a plurality of first slots through the first disk and the second passage means includes a plurality of second slots through the second disk.

4. The heating apparatus of claim 3 wherein each first slot is at an angle to a radius of the first disk, and each second slot is at an angle to a radius of the second disk.

5. The heating apparatus of claim 4 wherein the angle is approximately 45°.

6. The heating apparatus of claim 5 wherein the first slots are generally equally circumferentially spaced around the first disk, wherein the second slots are generally equally circumferentially spaced around the second disk, and wherein the first slots are offset with respect to the second slots.

7. The heating apparatus of claim 1 wherein the first and second disks are of generally equal diameter and wherein the means for attaching the first and second disks includes a spacer disk of a smaller diameter than the diameter of the first and second disks, the spacer disk being coaxially mounted adjacent to and between the first and second disks thereby defining the region in communication with the first and second passage means as an area in the periphery of the plate unit between the first and second disks and outside of a perimeter of the spacer disk.

8. The heating apparatus of claim 1 wherein the motor means includes:

a generally vertical drive shaft extending downward through the housing into the chamber, the shaft being fixedly attached to the plate unit; and a motor mounted above the housing for rotating the drive shaft about the drive axis so that the plate unit rotates parallel to a generally horizontal plane.

9. The heating apparatus of claim 8 wherein:

the housing includes a top wall and an opposite bottom wall;

the plate unit is mounted with the first disk generally parallel to and spaced from the first wall by a first distance and the second disk generally parallel to and spaced from the second wall by a second, greater distance.

10. The heating apparatus of claim 9 wherein:

the first distance is approximately one-third the second distance.

11. The heating apparatus of claim 1 wherein the viscous liquid is multi-viscosity synthetic oil.

12. The heating apparatus of claim 1 and further comprising:

a liquid return passage connecting a peripheral area of the chamber and a generally central area of the chamber for returning viscous liquid which has moved outward to the peripheral area by centrifugal force created by rotation of the plate unit within the chamber back to the central area.

13. The heating apparatus of claim 1 wherein the chamber is square shaped in cross-section perpendicular to the drive axis.

14. A heating apparatus comprising:

a housing defining a chamber for containing a viscous liquid;

a plate unit positioned within the chamber for rotation about a drive axis while immersed in the viscous liquid, the plate unit comprising:

a first disk generally perpendicular to the drive axis and having a first passage means for permitting flow of viscous liquid through the first disk;

a second disk generally perpendicular to the drive axis and having second passage means for permitting flow of viscous liquid through the second disk;

means for attaching the first and second disks in an axially spaced apart, generally parallel, fixed relation with a region between the first and second disks in communication with the first and second passage means;

motor means for rotating the plate unit about the drive axis within the chamber to cause heating of the viscous liquid;

a plenum above the housing;

a motor compartment for enclosing the motor, the motor compartment being open to the plenum;

air inlet means in the motor compartment for allowing the entrance of outside air;

an outlet duct in the plenum;

means to move air in through the air inlet means, through the motor compartment, through the plenum, and out the outlet duct; and heat exchanging fins attached to and extending upward from the housing for exchanging heat from the housing to surrounding air.

15. A heating apparatus comprising:

a housing defining a chamber for containing a viscous liquid, the chamber having parallel top and bottom walls and a plurality of generally planar, generally vertical side walls which meet at opposed corners spaced about a periphery of the chamber in cross-section along a generally horizontal plane;

a generally vertical shaft extending downward centrally through the top wall of the housing into the chamber;

motor means mounted above the housing for rotating the shaft;

a plate unit fixedly mounted on the shaft for rotation in the chamber of the housing parallel to a generally horizontal plane, the plate unit including:

a generally horizontal top disk having its periphery in close tolerance to an intermediate portion of each of the side walls and having a plurality of first slots therethrough, each first slot being aligned at an angle with respect to a radius of the first disk and extending outward to near a perimeter of the first disk, and wherein the first slots are generally equally circumferentially spaced around the first disk;

a generally horizontal bottom disk of a diameter generally equal to a diameter of the first disk, the bottom disk having a plurality of second slots therethrough, each second slot being aligned at an angle with respect to a radius of the second disk and extending outward to near a perimeter of the second disk and wherein the second slots are generally equally circumferentially spaced around the second disk; and a generally horizontal spacer disk of a diameter smaller than the diameter of the first and second disks, the spacer disk being fixedly coaxially mounted between and adjacent to the first and second disks for forming an internal peripheral region between the disks which communicates with the first and second slots.

16. The heating apparatus of claim 15 wherein the viscous liquid is multi-viscosity synthetic oil.

17. The heating apparatus of claim 15 wherein the angle of the first and second slots is approximately 45°.

18. The heating apparatus of claim 15 wherein the first slots are circumferentially offset with respect to the second slots.

19. The heating apparatus of claim 15 wherein the top of the housing is a heat conducting material for transferring heat generated within the chamber to a fluid outside the housing.

20. The heating apparatus of claim 19 and further comprising heat exchanger means attached to the top of the housing in heat conducting relationship.

21. The heating apparatus of claim 15 wherein the top disk is spaced from the top of the housing by a first distance, and the bottom disk is spaced from the bottom of the housing by a second, greater distance.

22. The heating apparatus of claim 21 wherein the first distance is approximately one-third the second distance.

23. The heating apparatus of claim 15 and further comprising:

a liquid return passage connecting a peripheral area of the chamber and a generally central area of the chamber for returning viscous liquid which has moved outward to the peripheral area by centrifugal force created by rotation of the plate unit with the chamber back to the central area.

24. The heating apparatus of claim 15 wherein the top and bottom disks are metal disks having a thickness of about 0.100 inch and wherein the spacer disk is a metal disk having a thickness of about 0.077 inch.

25. The heating apparatus of claim 24 wherein the top disk is spaced about 0.025 inch from the top of the housing and the bottom disk is spaced about 0.073 inch from the bottom of the housing.

26. The heating apparatus of claim 24 or 25 wherein the top and bottom disks have a diameter of about $11\frac{7}{8}$ inches and the spacer disk has a diameter of about 10 inches.

27. The heating apparatus of claim 24 wherein there are eight first slots and eight second slots.

28. The heating apparatus of claim 24 wherein the first and second slots have widths of about 3/16 inch and extend from near the periphery of the spacer disk to near the periphery of the top and bottom disks.

29. A heating apparatus comprising:

a housing having top, bottom, and side walls defining a chamber for containing a viscous liquid;

a generally vertical shaft extending downward through the top of the housing into the chamber;

motor means mounted above the housing for rotating the shaft;

a plate unit fixedly mounted on the shaft for rotation in the housing parallel to a generally horizontal plane, the plate unit including: a generally horizontal top disk having a plurality of first slots therethrough, each first slot being aligned at an angle with respect to a radius of the first disk and extending outward to near a perimeter of the first disk, and wherein the first slots are generally equally circumferentially spaced around the first disk;

a generally horizontal bottom disk of diameter generally equal to the diameter of the first disk, the bottom disk having a plurality of second slots therethrough, each second slot being aligned at an angle with respect to a radius of the second disk and extending outward to near a perimeter of the second disk and wherein the second slots are generally equally circumferentially spaced around the second disk;

a generally horizontal spacer disk of a diameter smaller than the diameter of the first and second disks, the spacer disk being fixedly coaxially mounted between and adjacent to the first and second disks for forming an internal peripheral region between the disks which communicates with the first and second slots;

a plenum above the housing;

heat exchanging fins extending upward from the housing in the plenum for exchanging heat from the housing to air in the plenum;

a motor compartment for enclosing the motor means, the motor compartment being open to the plenum;

an air inlet in the motor compartment for allowing entrance of outside air;

an outlet duct in the plenum; and means to move air in through the inlet, through the motor compartment, through the plenum across the heat exchanging fins, and out the outlet duct.

* * * * *